US005965837A

United States Patent [19]

Lee et al.

[11] Patent Number: 5,965,837

[45] Date of Patent: Oct. 12, 1999

[54] ARTILLERY SHELL CARRIER

[75] Inventors: Kang-il Lee; Sung-yong Bae; Hee-sun Kang; Byung-cheol Ahn, all of Changwon; Joon-yeol Im, Kimhae, all of Rep. of Korea

[73] Assignee: Samsung Aerospace Industries, Ltd, Kyongsangnam-Do, Rep. of Korea

[21] Appl. No.: 08/794,278

[22] Filed: Jan. 31, 1997

[30] Foreign Application Priority Data

Jan. 31, 1996 [KR] Rep. of Korea ..... 96-2364

[51] Int. Cl.[6] ..... F41A 9/38; F41A 9/13

[52] U.S. Cl. ..... 89/46; 89/45

[58] Field of Search ..... 89/45, 46, 47, 89/33.05

[56] References Cited

U.S. PATENT DOCUMENTS

| | | | |
|---|---|---|---|
| 380,688 | 4/1888 | Murray | 89/46 |
| 2,933,020 | 4/1960 | Hammer, Jr. | 89/45 |
| 5,440,966 | 8/1995 | Tellander et al. | 89/46 |

FOREIGN PATENT DOCUMENTS

| | | | |
|---|---|---|---|
| 58814 | 9/1982 | European Pat. Off. | 89/46 |
| 557751 | 9/1993 | European Pat. Off. | 89/47 |
| 3113296 | 5/1991 | Japan | 89/45 |

*Primary Examiner*—Stephen M. Johnson

*Attorney, Agent, or Firm*—Finnegan, Henderson, Farabow, Garrett & Dunner, L.L.P.

[57] ABSTRACT

A device for carrying artillery shells, each shell having a cylindrical body and a conical head, is disclosed. The device includes an upper body and a lower body. A gripper assembly is connected to the lower body and has an inner circumferential surface corresponding to the cylindrical body. A driving unit pivots the gripper assembly about an axis. A shell-head stopping unit is connected to the lower body at a position which may be adjusted along the length of the lower body. The shell-head stopping unit receives the conical head of a shell to hold the shell in a set position. Also included is a shell-rear stopping unit connected to the gripper assembly and elastically biased upward with respect to the inner circumferential surface of the gripper assembly. The shell-rear stopping unit holds the rear end of the shell in the gripper assembly.

9 Claims, 7 Drawing Sheets

ARTILLERY SHELL CARRIER

BACKGROUND OF THE INVENTION

1. Field of the Invention

The present invention relates to an artillery shell carrier. More particularly, the present invention relates to an artillery shell carrier which carries shells from a shell stacker to a shell loader.

2. Description of the Prior Art

Mobile artillery units are essential in modern warfare. These units must be able to move quickly while being heavily loaded with shells and must be able to fire each shell within a small predetermined period of time. Furthermore, since the shells are explosive, safety precautions must be incorporated into the design of the mobile unit's shell stacker.

A shell firing unit of, for example, a self-propelled artillery unit or a tank, is functionally divided into three parts: a shell stacker, a shell carrier, and a shell loader. Once the shell stacker stacks a plurality of shells, the shell carrier carries the stacked shells from the stacker to the shell loader. The shell loader then loads the shells into a gun barrel.

In the prior art, the function of the shell carrier is performed manually by artillerymen. However, due to the shell's heavy weight (typically 40–50 kg), artillerymen can be easily fatigued by carrying the shells. An additional problem with the prior art is that the manual carrying of the shells limits the firing speed of the shell firing unit, thus limiting the ability to achieve a concentrated attack.

SUMMARY OF THE INVENTION

An important advantage of the present invention is the provision of an arrangement which substantially obviates one or more of the limitations and disadvantages of the described prior art methods. In particular, the present invention is directed to an artillery shell carrier which rapidly and easily carries stacked shells.

Additional features and advantages of the invention will be set forth in the description which follows, and in part will be obvious from the description, or may be learned by practice of the invention. The objectives and other advantages of the invention may be realized and attained by the apparatus particularly pointed out in the written description and claims hereof, as well as the appended drawings.

To achieve these and other advantages and in accordance with the purpose of the invention, as embodied and broadly described, the invention comprises a device for carrying artillery shells, each shell having a cylindrical body and a conical head, including an upper body and a lower body. A gripper assembly is connected to the lower body and has an inner circumferential surface corresponding to the cylindrical body. A driving unit pivots the gripper assembly about an axis. A shell-head stopping unit is connected to the lower body at a position which may be adjusted along the length of the lower body. The shell-head stopping unit receives the conical head of a shell to hold the shell in a set position. Also included is a shell-rear stopping unit connected to the gripper assembly and elastically biased upward with respect to the inner circumferential surface of the gripper assembly. The shell-rear stopping unit holds the rear end of the shell in the gripper assembly.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of the specification, illustrate embodiments of the invention and, together with the description, serve to explain the objects, advantages, and principles of the invention. In the drawings.

DETAILED DESCRIPTION

Embodiments of the present invention will now be described with reference to the accompanying drawings.

Figure 1A:
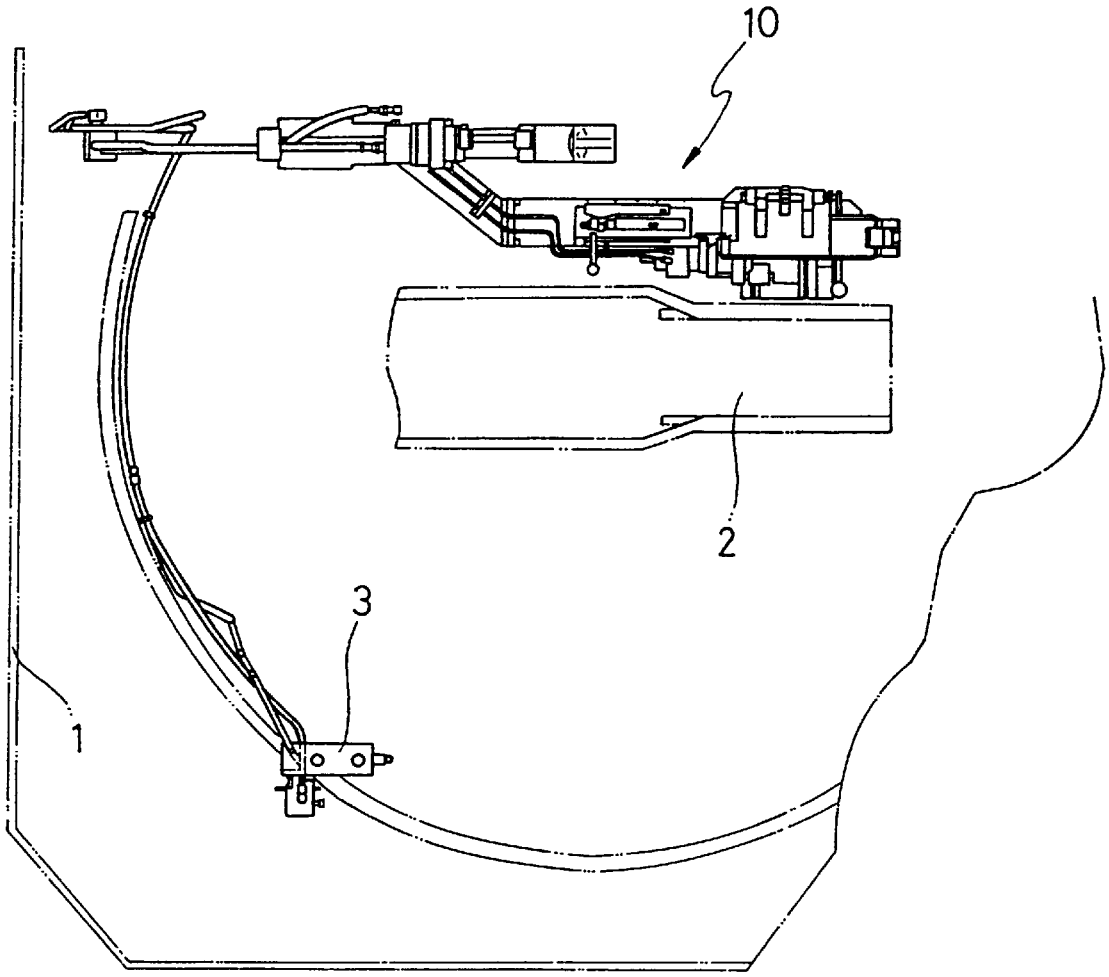
FIG. 1A is a plan view of an artillery shell carrier 10 according to the present invention.
Figure 1B:
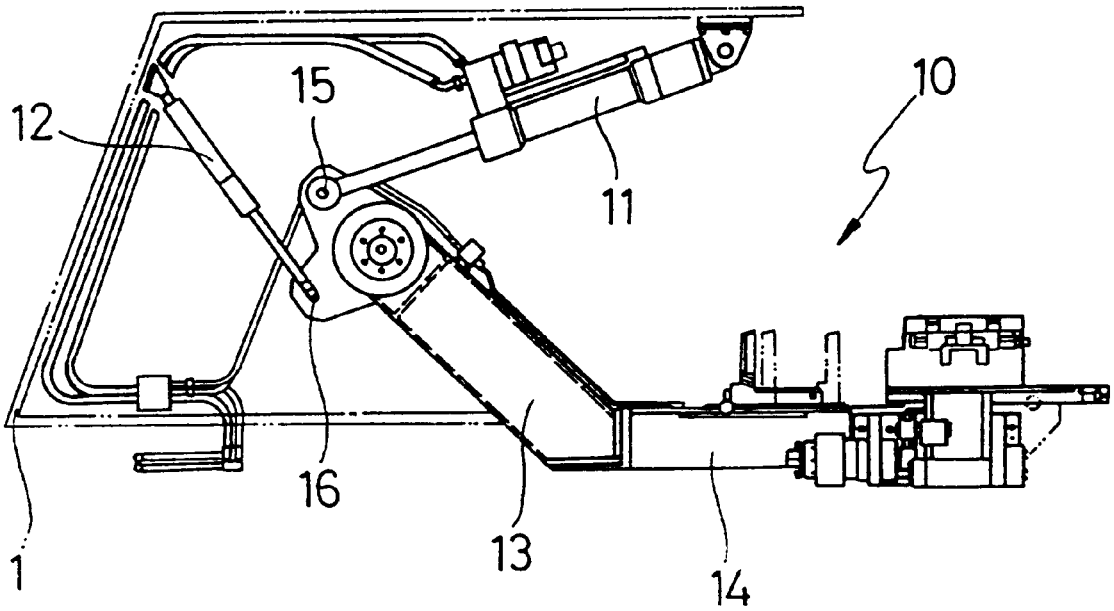
FIG. 1B is a front view of the artillery shell carrier 10 shown in FIG. 1A.

As illustrated in FIGS. 1A and 1B, a first preferred embodiment of an artillery shell carrier 10 is provided. Referring to FIG. 1A, artillery shell carrier 10 is installed at one side of a gun turret 1 and in parallel with a shell loader 2 of, for example, a tank or mobile artillery unit. The shell loader 2 is installed on an extension line of a gun barrel (not shown) which is generally positioned at the center of the gun turret 1. During operation, shell carrier 10 grips a shell, rotates it so that it is over shell loader 2, and then places the shell in the shell loader 2. Further, an oil pressure generator 3, installed in gun turret 1, operates shell carrier 10 by generating oil pressure.

As shown in FIG. 1B, the artillery shell carrier 10 is comprised of an upper body 13 and a lower body 14. Upper body 13 rotates at two points: point 15, where it is connected to a hydraulic oil cylinder 11; and at point 16, where it is connected to a gas spring 12. Hydraulic oil cylinder 11 and gas spring 12 operate to move upper and lower bodies 13 and 14 to various positions inside gun turret 1. For instance, the bodies 13 and 14 may be moved toward one of a plurality of extractors of a shell stacker (not shown), which are used for extracting the shells and which may be placed at various positions and heights in the turret 1.

Figure 2:
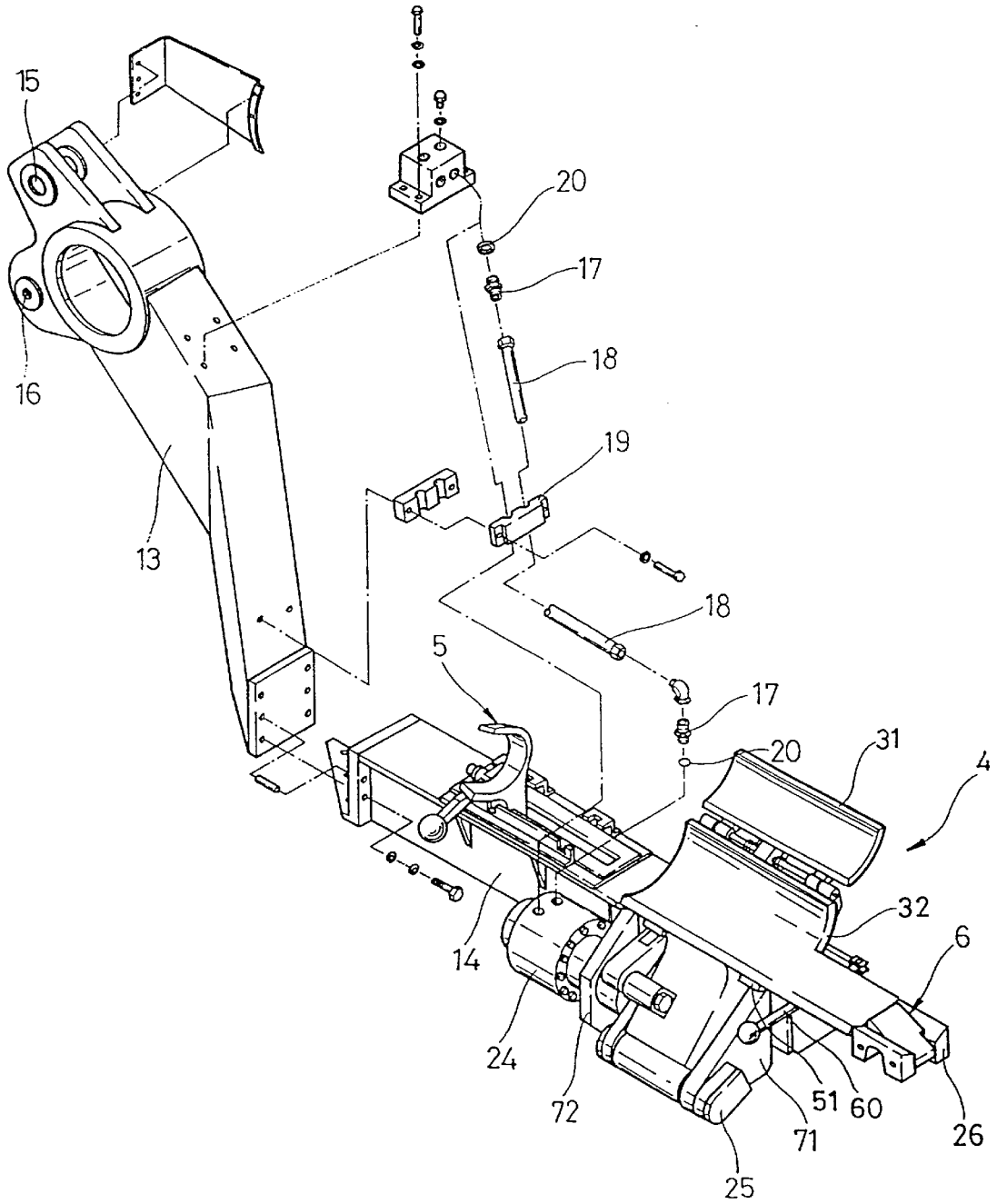
FIG. 2 is an exploded view of upper and lower bodies 13 and 14 shown in FIG. 1B.

FIG. 2 is an exploded view of upper and lower bodies 13 and 14 of artillery shell carrier 10 according to a preferred embodiment of the invention. Referring to FIG. 2, a hydraulic oil motor 24 is connected to one side of the lower body 14 and receives oil through a pipe 18. A bracket 19, a connector 17 and a seal 20 connect pipe 18 to lower body 13. A gripper assembly 4 is connected to lower body 14 and has an arc-shaped inner circumferential side to enable gripping of the cylindrically shaped shells (not shown). Also, a shell-head stop assembly 5 is connected to lower body 14 and is capable of changing its position along the length of lower body 14. Shell-head stop assembly 5 is shaped like a horseshoe to hold the shell by supporting the outer conic surface of the shell's head.

A shell-rear stop assembly 6 is connected to lower body 14 at the side opposite of shell-head stop assembly 5. As the shell is moved along the length of lower body 14, the shell's head passes over shell-rear stop assembly 6 and is inserted into gripper assembly 4. Since the upper surface of shell-rear stop assembly 6 is flat, the shell can easily slide along this surface as it is inserted into gripper assembly 4. Shell-rear stop assembly 6 is fixed to a spring (not shown) so that once the shell is inserted into gripper assembly 4, a shell-rear stopper 23 (see FIG. 3) will spring upward to keep the rear end of the shell from sliding out of gripper assembly 4. Furthermore, the shell carrier can be adjusted to accommodate shells of different lengths by adjusting the position of shell-head stop assembly 5 along the length of lower body 14.

Figure 3:
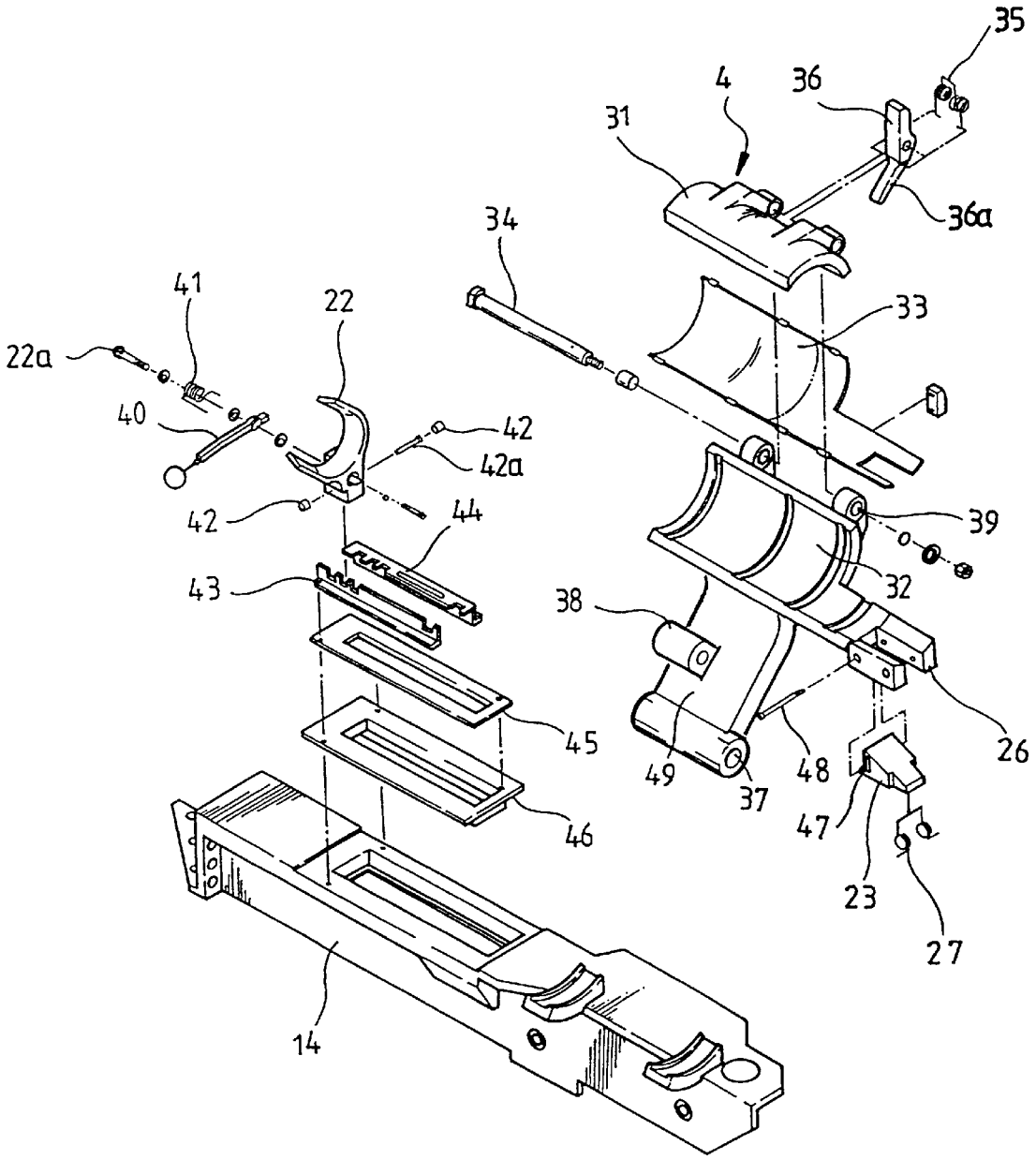
FIG. 3 is an exploded view of gripper assembly 4, shell-head stop assembly 5, and shell-rear stop assembly 6 shown in FIG. 2.

FIG. 3 illustrates in detail the structure of gripper assembly 4, shell-head stop assembly 5, and shell-rear stop assembly 6. Referring to FIG. 3, gripper assembly 4 includes an upper gripper 31, a gusset member 33, a lower gripper 32 and a connecting shaft 34. Lower gripper 32 has a rotary arm 49 which includes a connecting-rod pin coupling hole 38 and a gripper shaft coupling hole 37. When combined, the assembled upper and lower grippers 31 and 32 pivot around a gripper shaft (not shown). The gripper shaft is connected to gripper shaft coupling hole 37 and has a pivot radius equal to the length of rotary arm 49. Gusset member 33 prevents frictional damage to the shell's surface, and is formed congruous with the inner circumferential surface of lower gripper 32 and is fixed to the inner surface of gripper 32. Accordingly, when gripper assembly 4 grips the shell, the shell is placed on the surface of gusset member 33.

Connecting shaft 34, inserted through holes 39 of lower gripper 32, causes upper gripper 31 to pivot with respect to lower gripper 32. The combination of connecting shaft 34 and a spring 35 helps upper and lower grippers 31 and 32 create the gripping action. That is, through the use of only the restoring force of spring 35, upper and lower grippers 31 and 32 grip a shell placed between them. Further, the gripping action is facilitated by the use of an upper gripper stopper 36, having a protruding portion 36*a,* that is connected to the outside of gripper 31.

A shell-rear stopper base 26 is integrally formed as part of lower gripper 32 and is connected to shell-rear stopper 23. A hole 47 is formed in shell-rear stopper 23 through which a pin 48 is inserted to connect shell-rear stopper 23 to stopper base 26. A spring 27 is coupled to an end of shell-rear stopper 23 to elastically bias stopper 23. The elastic force of the spring causes stopper 23 to protrude from the inner circumferential surfaces of lower gripper 32 and gusset member 33.

Using a pin 42*a,* a roller 42 is assembled to a lower portion of shell-head stopper 22. Roller 42 moves lengthwise along a roller slot formed between guiders 45 and 46 so that shell-head stopper 22 can be adjusted to a position along the length of lower body 14. The position of the shell-head stopper 22 is adjusted through the use of a combination comprising a lever 40, a spring 41, an interval controller 43, and an interval maintainer 44. The body of lever 40 is inserted into one of at least two indentures formed on interval controller 43. Spring 41, coupled by a pin 22*a* to the lever 40, applies an elastic force to lever 40 in both a rotational direction around pin 22*a* and in a lengthwise direction along pin 22*a*. To change the position of shell-head stopper 22, lever 40 is pivoted against the elastic force of spring 41 to remove the lever 40 from an indenture of interval controller 43. Lever 40 is then moved along the length of pin 22*a* to a desired position, inserted into a corresponding indenture, and locked therein by the elastic force of spring 41.

Figure 4:
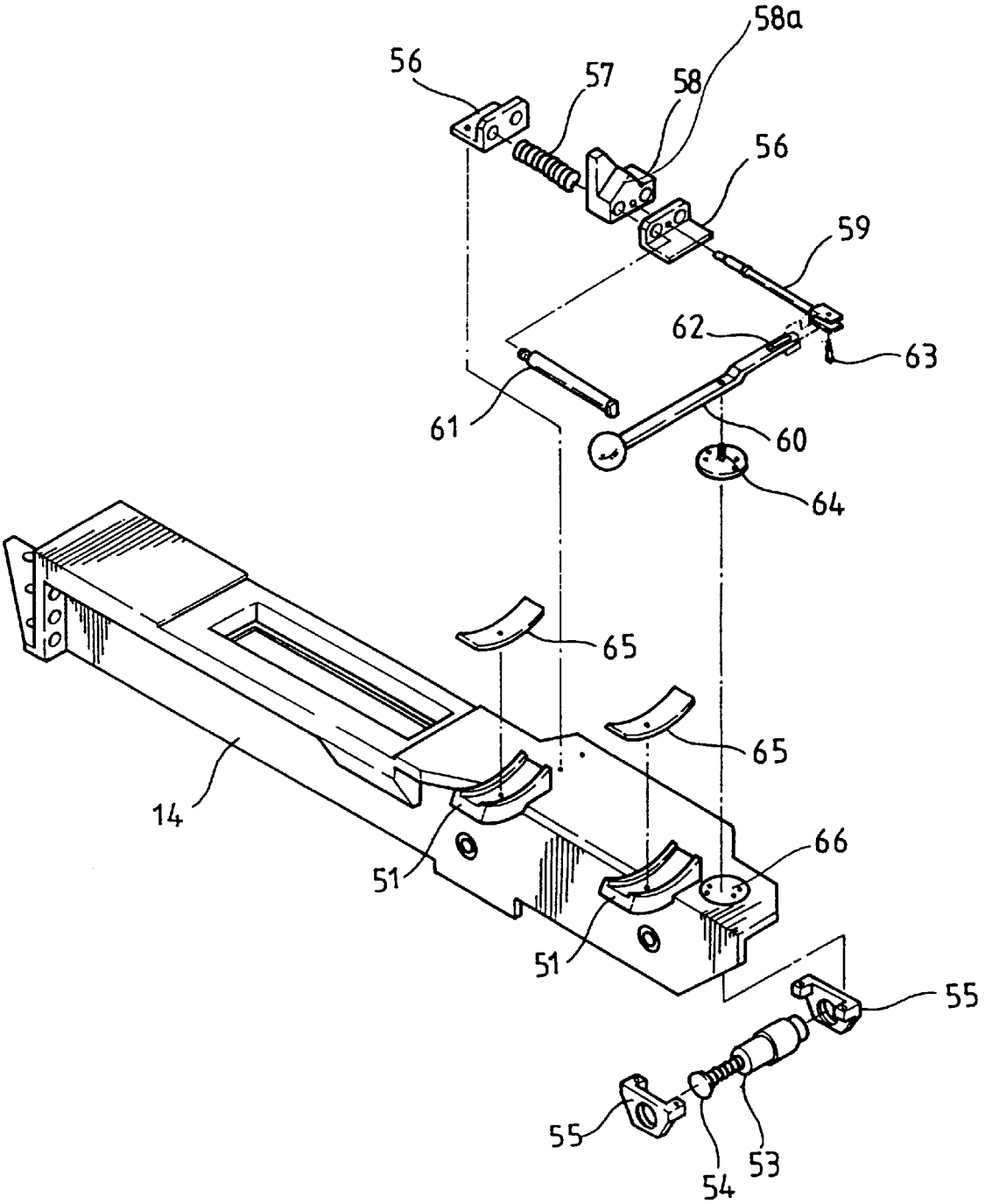
FIG. 4 is an exploded view of moving block portion and buffer portion

Referring to FIG. 4, two brackets 56 are fixed onto an upper portion of lower body 14, and a guide shaft 61 is inserted between the two brackets 56. Shaft 61 is inserted through a spring 57 and a mobile block 58. Mobile block 58 has a cam surface 58*a* which contacts the protruding portion 36*a* (see FIG. 3) of upper gripper stopper 36, a hole through which guide shaft 61 passes, and a closed hole to which one end of a rod 59 is inserted for pushing mobile block 58. Mobile block 58 can be moved along guide shaft 61 and is elastically biased by spring 57. Rod 59 is connected to a lever 60 by a pin 63 inserted through a hole 62 of lever 60.

Lever 60 is pivotally coupled to a pivot shaft 64. Pivot shaft 64 is connected to a portion 66 on lower body 14. Also on lower body 14 are gripper supports 51, formed to have a curvature corresponding to the outer circumferential surface of lower gripper 32 (see FIG. 3). A buffer 53 is fixed to brackets 55 on the lower portion of the lower body 14. A buffering portion 54, elastically biased by a spring, protrudes from bracket 55 by passing through a hole formed therein. The buffer 53 absorbs impacts generated by the pivotal movement of gripper assembly 4.

Figure 5:
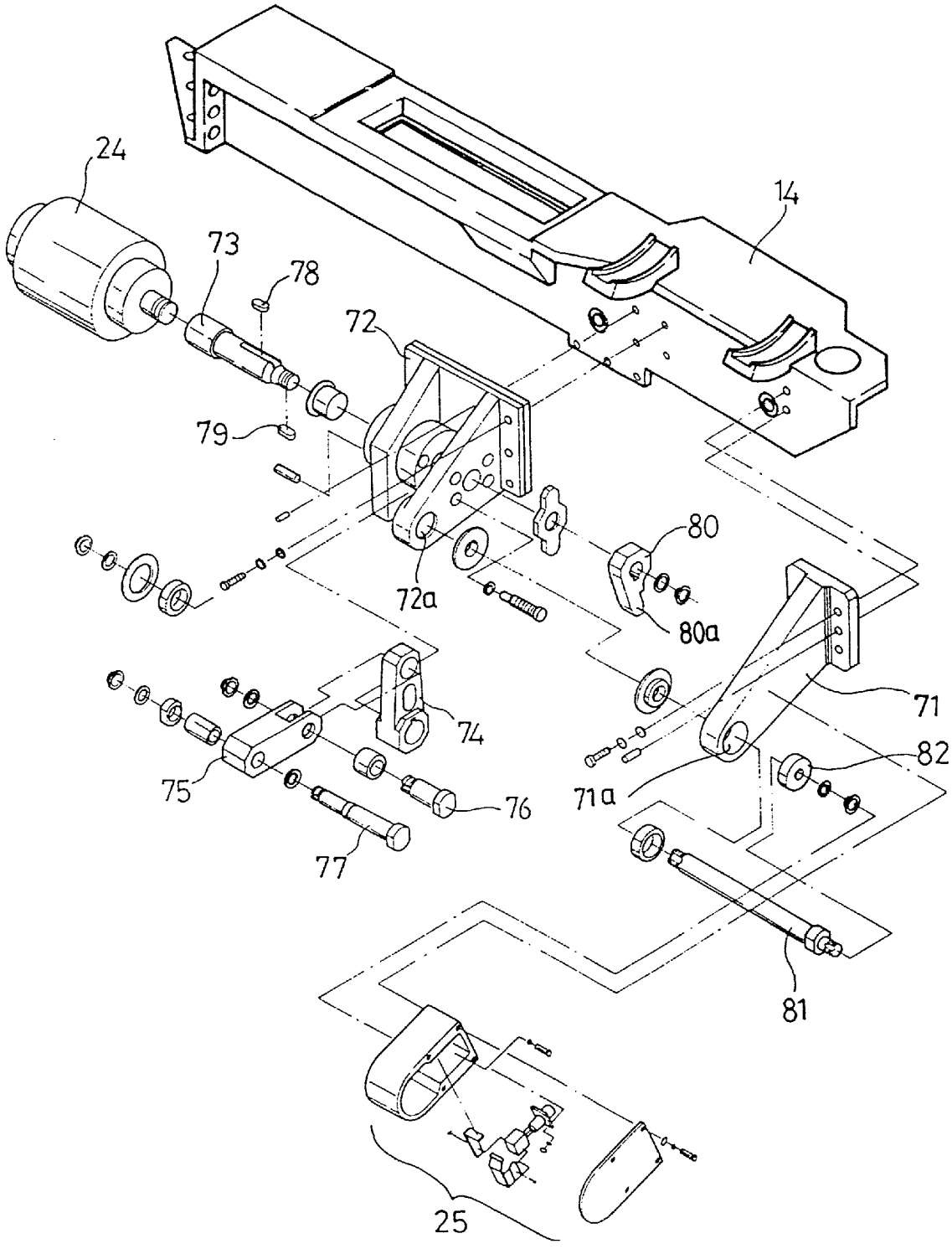
FIG. 5 is an exploded view of gripper driving means and limit switch.

Referring to FIG. 5, brackets 71 and 72 are fixed to the side of lower body 14 to support gripper assembly 4 (see FIG. 2) and hydraulic oil motor 24. Gripper assembly 4 pivots around a shaft 81 that passes through three holes: a hole 71*a* of bracket 71; gripper shaft coupling hole 37 (see FIG. 3); and a hole 72*a* of bracket 72.

One end of a driving shaft 73 is connected to the rotational shaft of hydraulic oil motor 24, while the other end of shaft 73 is connected to a driving arm 74. To prevent shaft 73 from slipping with respect to driving arm 74, a key 78 is preferably used to connect the two together. A pin 76 connects driving arm 74 to an end of a connecting rod 75 such that arm 74 may pivot around pin 76. The other end of connecting rod 75 rotates around a pin 77, and end of which is inserted into coupling hole 38 (see FIG. 3) of lower gripper 32. Driving arm 74 and connecting rod 75 thus constitute a crank mechanism allowing gripper assembly 4 to pivot by the rotation of hydraulic oil motor 24. Also, the rotation of hydraulic oil motor 24 can be controlled by a limit switch 25 installed at one side of bracket 71. Limit switch 25 controls hydraulic motor 24 by detecting the rotation of a cam 82 coupled to one end of shaft 81.

A motor rotation stopper 80 is connected to the end of driving shaft 73 by a key 79. A protruding portion 80*a* of motor rotation stopper 80 contacts buffer 53 (see FIG. 4) according to the rotation angle of the driving shaft 73. As described above, buffer 53 is thus able to absorb the impact generated by the pivotal movement of gripper assembly 4, thereby reducing the possibility that the shell will explode.

Figure 6:
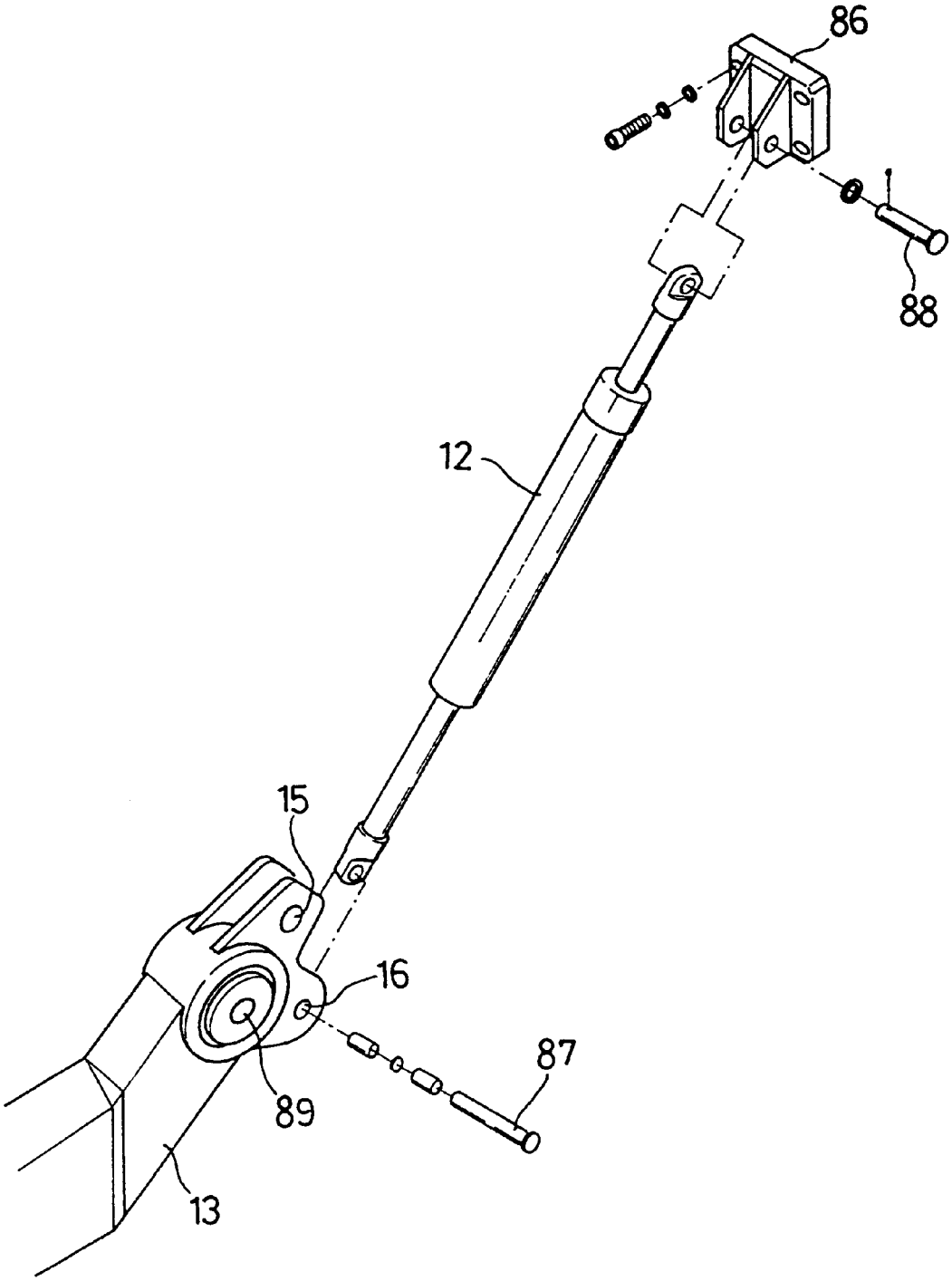
FIG. 6 is an exploded view of body moving means.

Referring to FIG. 6, artillery shell carrier 10 (see FIG. 1B) according to the present invention is coupled by gas spring 12 to a bracket 86 that is fixed to a gun turret (not shown in FIG. 6). Thus one end of gas spring 12 is rotatably coupled with upper body 13 by a pin 87, while the other end of spring 12 is rotatably coupled with bracket 86 by a pin 88. Since upper body 13 pivots around a combination shaft 89, the artillery shell carrier 10 can be moved to many different positions. Hydraulic oil cylinder 11 (see FIG. 1B) is coupled to a hole 15, and upper body 13 rotates by the driving force of hydraulic oil cylinder 11 so that the artillery shell carrier can be moved to a different position. Any unbalance of the artillery shell carrier's movement, and any impact caused by the rotation of the upper body 13, can be alleviated by shock means such as gas spring 12.

Hereinafter, the operation of the shell carrier according to the present invention will be described. Referring to FIG. 1B, hydraulic oil cylinder 11 and gas spring 12 rotate artillery shell carrier 10 to a location where the shells (not shown) are stacked. Next, as shown in FIG. 2, gripper assembly 4 pivots to contact the gripper support 51 formed on the lower body 14. Protruding portion 36*a* of upper gripper stopper 36 (in FIG. 3) then contacts cam surface 58*a* (in FIG. 4) of mobile block 58. In following, upper gripper 31 is opened by the elastic force of spring 35.

In this fashion, gripper assembly 4 enters into a "release" mode in which it is ready to receive a shell. The impact-proof member 65 (FIG. 4) absorbs the impact generated between the gripper assembly 4 and the gripper support 51.

Prior to receiving a shell in gripper assembly 4, the position of shell-head stopper 22 can be adjusted to the length of the shell by manipulating lever 40 shown in FIG. 3. Then, the shell is inserted into gripper assembly 4 by directing the shell's head towards shell-head stopper 22. The conic shaped shell head is inserted into shell-head stopper 22 and is supported by lower gripper 32. In doing so, the weight of the shell presses shell-rear stopper 23 downward. After the rear of the shell completely passes shell-rear stopper 23, spring 27 causes stopper 23 to rise again, thus preventing the shell from slipping backwards out of gripper 4.

After the shell is received in gripper assembly 4, lever 60 (see FIGS. 2 and 4) is pulled so that upper gripper 31 is biased toward lower gripper 32. The device thereby enters a "gripping" mode. That is, when lever 60 is pulled, rod 59 pushes mobile block 58 against the elastic force of spring 57, and the protruding portion 36*a* of upper gripper stopper 36 (see FIG. 3) escapes from cam surface 58*a* of mobile block 58. Accordingly, upper gripper 31, which is pressed by spring 35 (see FIG. 3), can grip the shell together with lower gripper 32. When the shell is gripped, hydraulic oil cylinder 11 (see FIG. 1B) operates to move gripper assembly 4 to a position where the shell can be carried to the shell loader (not shown).

In FIG. 5, hydraulic motor 24 transfers power to gripper assembly 4 via a crank mechanism 74 and 75 (see FIG. 2), causing gripper assembly 4 to be pivoted at a predetermined angle around shaft 81 for carrying a shell to a shell loader (not shown). Limit switch 25 stops the pivotal movement of the gripper assembly 4 by stopping the operation of hydraulic oil motor 24. At this time, protruding portion 80*a* of stopper 80, coupled with motor driving shaft 73, buffers the impact generated by an abrupt halt of motor 24 by bumping against buffering portion 54 of buffer 53 installed at one side of lower body 14.

While gripper assembly 4 pivots to a loading position, mobile block 58 (see FIG. 4) is returned to its initial position by the elastic force of spring 57. When gripper assembly 4 pivots to a position above lower body 14 and enters a "ready" mode after completing a loading, protruding portion 36*a* of upper gripper stopper 36 contacts cam surface 58*a* of mobile block 58 causing gripper assembly 10 to enter the "release" mode.

As described above, artillery shell carrier 10 according to the present invention enables rapid and easy carrying of shells from a shell stacker to a shell loader so that the speed of firing shells can be improved. Furthermore, the above artillery shell carrier can be applied regardless of the position of the extractor of the shell stacker and the length of the shell. Particularly, the shell carrying operation performed through hydraulic oil motor 24 and limit switch 25, which controls the operation of the hydraulic oil motor, improves the convenience of the device for an artillery crew.

It is noted that the present invention is not limited to the preferred embodiment described above, and it is apparent that variations and modifications by those skilled in the art can be effected within the spirit and scope of the present invention defined in the appended claims.

What is claimed is:

1. A device for carrying artillery shells, each shell having a cylindrical body and a conical head, comprising:

an upper body and a lower body;

a gripper assembly connected to the lower body and having an inner circumferential surface corresponding to the cylindrical body;

a driving unit for pivoting the gripper assembly about an axis;

a shell-head stopping unit connected to the lower body at a position which may be adjusted along the length of the lower body, wherein the shell-head stopping unit receives the conical head of a shell to hold the shell in a set position; and a shell-rear stopping unit connected to the gripper assembly and elastically biased upward with respect to the inner circumferential surface of the gripper assembly, wherein the shell-rear stopping unit holds the rear end of the shell in the gripper assembly.

2. The device of claim 1, wherein said gripper assembly further comprises:

an upper gripper;

a lower gripper which is pivotally coupled to the upper gripper;

an elastic member for providing an elastic force to the upper gripper to grip a shell inserted between the upper gripper and the lower gripper; and a rotary arm integrally formed with the lower gripper to form a radius from the axis about which the driving unit pivots the gripper assembly.

3. The device of claim 2, wherein the driving unit comprises a driving shaft, the device further comprising:

a driving arm having a first end connected to the driving shaft, wherein the driving arm pivots the gripper assembly by a driving force of the driving unit; and a connecting rod having a first end connected to the second end of the driving arm and having a second end connected to the lower gripper.

4. The device of claim 3, further comprising:

a rotation stopper coupled to the driving shaft; and a buffer connected to the lower body for absorbing an impact which occurs when the driving unit stops driving.

5. The device of claim 2, further comprising:

an upper gripper stopper connected to the upper gripper;

a mobile block connected to the lower body and having a cam surface contacting the upper gripper stopper;

an elastic member having an elastic force used to elastically bias the mobile block; and a rod for moving the mobile block against the elastic force of the elastic member such that the cam surface of the mobile block is not in contact with the upper gripper stopper.

6. The device of claim 2, wherein the shell-rear stopping unit is connected to the lower gripper.

7. The device of claim 1, wherein the shell-head stopping means comprises:

a shell-head stopper;

means for rolling the shell-head stopper along the length of the lower body;

an interval controller for holding the shell-head stopper at a position along the length of the lower body to which the stopper was moved by the rolling means.

8. The device of claim 1, further comprising:

a pivot shaft forming the axis about which the gripper assembly is pivoted;

a cam coupled to the pivot shaft; and a limit switch for controlling the driving unit by detecting the rotation of the cam on the pivot shaft.

9. The device of claim 1, further comprising means for moving the upper and lower bodies to a loading position.

* * * * *